US011039984B2

(12) United States Patent
Hellenbrand

(10) Patent No.: US 11,039,984 B2
(45) **Date of Patent: *Jun. 22, 2021**

(54) ASSEMBLY FOR PACKAGING DRUG PORTIONS IN DISPENSATION PACKS AND METHOD FOR REFILLING A RESERVOIR OF A STORING AND METERING STATION OF A DISPENSING MACHINE WITH DRUG PORTIONS

(71) Applicant: CareFusion Germany 326 GmbH, Kelberg (DE)

(72) Inventor: Christoph Hellenbrand, Kaifenheim (DE)

(73) Assignee: CareFusion Germany 326 GmbH, Kelberg (DE)

( * ) Notice: Subject to any disclaimer, the term of this patent is extended or adjusted under 35 U.S.C. 154(b) by 173 days.

This patent is subject to a terminal disclaimer.

(21) Appl. No.: 16/393,782

(22) Filed: Apr. 24, 2019

(65) Prior Publication Data

US 2019/0247280 A1 Aug. 15, 2019

Related U.S. Application Data

(63) Continuation of application No. 14/912,817, filed as application No. PCT/EP2014/066815 on Aug. 5, 2014, now Pat. No. 10,307,338.

(30) Foreign Application Priority Data

Aug. 21, 2013 (EP) ..... 13181201

(51) Int. Cl.
*B65B 5/10* (2006.01)
*B65B 1/04* (2006.01)
(Continued)

(52) U.S. Cl.
CPC ..... *A61J 7/0084* (2013.01); *A61J 3/07* (2013.01); *B65B 1/04* (2013.01); *B65B 1/30* (2013.01);
(Continued)

(58) Field of Classification Search
None
See application file for complete search history.

(56) References Cited

U.S. PATENT DOCUMENTS 5,930,145 A 7/1999 Yuyama et al.
6,405,893 B1 6/2002 Tobe et al.
(Continued)

FOREIGN PATENT DOCUMENTS

WO WO-2013/034504 A1 3/2013

OTHER PUBLICATIONS

The International Preliminary Report on Patentability dated Mar. 3, 2016 in PCT Appln. No. PCT/EP2014/066815 (7 pages).
(Continued)

*Primary Examiner* — Stephen F. Gerrity
(74) *Attorney, Agent, or Firm* — Morgan, Lewis & Bockius LLP

(57) ABSTRACT

The invention relates to an arrangement for packing drug portions into dispensing packages. A dispensing machine includes a plurality of storing and metering stations having a plurality of drug portions, a packing device that receives the drug portions dispensed by the storing and metering stations and places them into dispensing packages, and a control device. Each storing and metering station includes a stationary part fixed to a frame, a removable part containing a refillable reservoir and has an information memory for storing an identifier of the removable part. A reading device for reading the information memory is functionally assigned to the stationary part. Each information memory contains a
(Continued)

memory location for a filling code. Every time the reservoir has been refilled, the filling code is changed at the charging station so that the refilling can be detected by the control device when the information memory is read by the reading device after the removable part has been placed back onto the stationary part of the same or a different storing and metering station.

20 Claims, 4 Drawing Sheets

(51) Int. Cl.
*B65B 1/30* (2006.01)
*A61J 7/00* (2006.01)
*A61J 3/07* (2006.01)

(52) U.S. Cl.
CPC ..... *B65B 5/103* (2013.01); *A61J 2205/10* (2013.01); *A61J 2205/60* (2013.01)

(56) References Cited

U.S. PATENT DOCUMENTS

| | | | |
|---|---|---|---|
| 7,747,345 | B2 | 6/2010 | Ohmura et al. |
| 8,234,838 | B2 | 8/2012 | Yasunaga et al. |
| 10,307,338 | B2 * | 6/2019 | Hellenbrand ..... B65B 5/103 |
| 2007/0078410 | A1 | 4/2007 | Chiavetta |
| 2009/0287992 | A1 | 11/2009 | Bresolin |
| 2013/0340390 | A1 | 12/2013 | Carson et al. |
| 2015/0225101 | A1 | 8/2015 | Van Wijngaarden |

OTHER PUBLICATIONS

International Search Report dated Oct. 27, 2014 in PCT/EP2014/066815 (7 pages).
Written Opinion dated Feb. 26, 2015 in PCT/EP2014/066815 (5 pages).

* cited by examiner

ASSEMBLY FOR PACKAGING DRUG PORTIONS IN DISPENSATION PACKS AND METHOD FOR REFILLING A RESERVOIR OF A STORING AND METERING STATION OF A DISPENSING MACHINE WITH DRUG PORTIONS

CROSS-REFERENCE TO RELATED APPLICATIONS

This application is a continuation of U.S. patent application Ser. No. 14/912,817, filed on Feb. 18, 2016, entitled "ASSEMBLY FOR PACKAGING DRUG PORTIONS IN DISPENSATION PACKS AND METHOD FOR REFILLING A RESERVOIR OF A STORING AND METERING STATION OF A DISPENSING MACHINE WITH DRUG PORTIONS," which issued as U.S. Pat. No. 10,307,338, on Jun. 4, 2019, which is a U.S. National Phase under 35 U.S.C. § 371 of International Application No. PCT/EP2014/066815, filed on Aug. 5, 2014, which claims the benefit of EP13181201.8, filed on Aug. 21, 2013. The entire contents of these applications are incorporated by reference herein.

BACKGROUND OF THE INVENTION

The invention relates to an arrangement for packing drug portions into dispensing packages, comprising a dispensing machine, wherein the dispensing machine comprises a plurality of storing and metering stations which can each accommodate a plurality of drug portions and individually discharge the same, a packing device which receives the drug portions dispensed by the storing and metering stations and places them into dispensing packages, and a control device which controls the reservoir and metering stations and the packing device, wherein each storing and metering station comprises a stationary part which is fixed to a frame of the dispensing machine, and a removable part which contains a refillable reservoir for drug portions, wherein the removable part has an information memory, and wherein a reading device for reading the information memory is functionally assigned to the stationary part.

An arrangement of the type named above is known from EP 1 634 560 A1. In this known arrangement, the information memory is part of an HF tag, and stores information on the tablets contained in the reservoir—such as their names, the number of tablets present, and the tablet weight, by way of example. The stationary part contains a tablet information access unit which is connected to a host computer and which is given an address. The tablet information access unit has an HF module with an antenna for the purpose of communicating with the HF tag. The information to be stored in the memory of the HF tag is written into the tablet information access unit via the HF module under the control of the host computer when the removable part is first placed on the stationary part, and the address of the tablet information access unit serves as an identifier. The host computer can request the address and/or identifier of the tablet information access unit and the tablet information queried from the memory of the HF tag by the tablet information access unit, and store the same in its memory together with the position of the storing and metering station.

In addition, such an arrangement is known from the patent application EP 12 182 634.1, which is not yet published, said arrangement comprising a charging station which serves the purpose of refilling drug portions into the reservoir of a removable part, which has been removed, of the storing and metering station. In this arrangement, the information regarding the tablets or capsules is written into the information memory when the reservoir is filled at the charging station. This information includes, in addition to the information which identifies the drug, information on the batch which is currently being refilled—for example the expiration date or the number of drug portions refilled.

Proceeding from this arrangement, the problem addressed by the invention is that of enabling the control device to reliably detect whether the reservoir of a removable part which has been (re-) placed on a stationary part has been refilled, or has only been removed temporarily for other reasons, and whether the data pertaining to the refilling has been correctly acquired by a database of the control device.

This problem is addressed according to the invention by an arrangement and/or a method having the features discussed below.

The arrangement according to the invention for packing drug portions into the dispensing package comprises a dispensing machine and at least one charging station. The dispensing machine has a plurality of storing and metering stations which each accommodate and can individually discharge a plurality of drug portions, a packing device which receives the dispensing package discharged by the storing and metering stations and places the same into drug portions, and a control device which controls the storing and metering stations and the packing device. Each storing and metering station has a stationary part attached to a frame or housing of the dispensing machines, and a removable part containing a refillable reservoir for drug portions. The removable part has an information memory which stores an identifier of the removable part, among other things. A reading device for the purpose of reading the information memory is functionally assigned to the stationary part. The at least one charging station serves the purpose of refilling drug portions into the reservoir of a removable part, which has been removed, of the storing and metering station. Each information memory contains a memory location for a filling code. Every time the reservoir has been refilled, the filling code is changed at the charging station in such a way that the refilling can be detected by the control device when the information memory is read by the reading device after the removable part has been placed back onto the stationary part of the same or a different storing and metering station.

This storing and modifying of a filling code has the advantage that, after the removable part has been replaced on a stationary part, it is possible to check, during a subsequent comparison of the filling code stored in the removable part—the current filling code—with a modified filling code transferred to a database by the charging station during the filling of the reservoir—the target filling code—whether these are the same. If this is not the case, an error has occurred; by way of example, the target filling code, and along with it, the data on the new filling of the reservoir, has not been properly transmitted to the database. In this case, the control device of the dispensing machine knows that it cannot use the (obsolete) data, contained in the database, on the drug portions contained in the reservoir.

In one simple embodiment, the memory location stores a bit for the filling code, the value of which is inverted after each refilling at the charging station. These two possible values of the filling code memory are adequate for detecting the simple fact of a refilling. However, this simple variant is prone to errors, such that a further bit (checkbit) should optionally be redundantly added. As an alternative, an incrementally increasing number—that is, a fill counter—can be used for each filling. In one preferred embodiment, the filling code is a time stamp which corresponds to the refilling at the charging station. The time stamp can simply contain a date—for reservoirs which can never be filled twice per day. However, it can also contain a time or a value of a random counter which counts independently of date and time. This manner of filling code is more secure, and also allows recording of a filling history.

In one preferred embodiment, the reading device which is functionally assigned to the stationary part has devices for wireless communication with the information memory. Such devices can be based on modulated alternating magnetic or electromagnetic fields in the low- or high-frequency range, or optical signals. This avoids mechanical contacts between the removable part and the stationary part, and increases reliability. The wireless communication must, of course, be configured (for range limitation or alternating coding) in such a manner that the communication procedures of neighboring storing and metering stations do not interfere with each other.

The reading device which is functionally assigned to the stationary part can be attached to the frame or housing near to the stationary part. Multiple stationary parts can also be functionally assigned to one reading device. In one preferred embodiment, however, the stationary part of each storing and metering station contains one reading device. This makes it possible to arrange the reading device and the information memory close to each other, which reduces the consumption of energy during the reading process. If the reading device and the information memory each have transmitting/receiving devices for wireless communication, the close arrangement allows very small ranges and transmission powers, which reduces the risk of mutual interference between neighboring storing and metering stations, and also reduces the energy consumption.

The information memory is preferably a non-volatile solid state memory—for example a battery supported RAM or, preferably, an EEPROM, for example a flash storage. Such a solid state memory takes up little space and is therefore easily accommodated in the removable part.

In one preferred embodiment, the information memory is connected to an RFID component, or is contained in an RFID component. The RFID component can be designed in such a manner that it works without its own power supply—that is, it is inductively powered by the reading device and/or the read/write device when read or written to.

One preferred embodiment is characterized in that the stationary part of the storing and metering station contains a first part of a dispensing device, and the removable part of the storing and metering station contains a second part of the dispensing device, wherein the first part of the dispensing device contains a drive for the purpose of driving a separating mechanism to output individual drug portions, wherein the second part of the dispensing device has an outlet opening of the reservoir. In this embodiment, the first part of the dispensing device preferably has a controller which is coupled to the reading device and to the control device. In addition, the second part of the dispensing device preferably contains a separation mechanism which is driven by the drive and which is matched to the shape of the drug portions. This division of the elements of the dispensing device between the stationary part and the removable part has the advantage that elements which must be adapted to the type and shape of the drug portions are accommodated in the removable part which comprises the reservoir, and therefore can be adapted to the drug portions contained therein. In contrast, the elements which either need a power supply voltage (such as the drive motor, for example), or which have an uninterrupted communication connection to the control device (such as, by way of example, the controller coupled to the reading device and/or the drive), are accommodated in the stationary part, which can be connected to the voltage supply and/or the control device via cables.

The changed filling code could be changed at the charging station after the refilling, by means of a programming device in a separate step. However, the charging station preferably has a read/write device for reading information from the information memory, comprising the identifier of the removable part, and for writing information into the information memory, comprising the filling code. This read/write device can be arranged in such a manner that it can communicate with the information memory of the removable part during the filling.

In the method according to the invention for refilling a reservoir of a storing and metering station of a dispensing machine with drug portions, first in a step a) a removable part, containing the emptied reservoir of a storing and metering station is removed and transported to a charging station. The dispensing machine has a plurality of storing and metering stations, a packing device which receives drug portions discharged by the storing and metering stations and places the same in dispensing packages, and the control device which controls the packing device. Each storing and metering station comprises a stationary part and a removable part which contains the refillable reservoir. The removable part has an information memory which stores an identifier, among other things, and a memory location for a filling code. A reading device for the purpose of reading the information memory is functionally assigned to the stationary part. Before and during this removal and transport to the charging station, the memory location contains a first value for the filling code. In a step b), the identifier is read at the charging station, the reservoir is refilled with a prespecified amount of drug portions, and a second value is written into the memory location for the purpose of storing the filling code. In a step c), the second value is saved, together with the identifier which has been read, in a database which can be read by the control device. This database can be, by way of example, part of the control device, or can be arranged outside of the dispensing machine. In a step d), which can be carried out after or in parallel to step c), by way of example, the removable part, with the filled reservoir, is transported back to the dispensing machine and placed on the stationary part of the original or a different storing and metering station. Then the identifier and the filling code of the information memory are read. Next, in a step e), the identifier which has been read, and the value of the filling code which has been read, are compared to the corresponding values in the database, and an error signal is generated if they do not match.

As explained above with reference to the arrangement, in a simple embodiment, the memory location stores a bit for the filling code, the value of which is inverted in step b) after each refilling at the charging station, and the resulting value is saved in the database in step c). In one preferred embodiment, the filling code is a time stamp which corresponds to the time of the refilling at the charging station, wherein the time stamp is stored in the memory location for the filling code in step b), and is saved in the database in step c).

One preferred embodiment of the method is characterized in that in step c), the entry of the database which stores the filling code is addressed by means of the identifier which has been read. This simplifies the method and avoids an additional storage of an assignment of the identifier to the memory location addresses in the database.

In one preferred implementation of the method, in step c), in addition to the filling code, details of the new contents of the reservoir, such as the number and the expiration date of the drug portions which have been filled, are also saved in the database. This enables an automatic adjustment of the data available to the control device of the dispensing machine regarding the drugs in the reservoirs.

Preferably, in step b), the database is queried using the identifier which has been read, and a determination is made using the information saved there as to which type of drug portions must be refilled.

In one preferred embodiment, prior to the refilling in step b), a charging reservoir is provided, an identifier attached to this charging reservoir is read, and a determination is made, using the charging reservoir identifier which has been read and the identifier which has been read from the information memory of the removable part, as to whether the charging reservoir contains the correct drug portions to be refilled. This charging reservoir identifier can have, by way of example, the form of a barcode, and the identifier can be read by means of a scanner, for example. This approach improves the reliability of a correct filling of the reservoir.

Advantageous and/or preferred implementations of the invention are discussed below.

SUMMARY

One or more embodiments include a drug packing system, having a controller and a dispensing machine. The dispensing machine includes at least one storing and metering station configured to discharge drug portions individually. The storing and metering station includes a stationary portion fixed to the dispensing machine, and a removable portion, the removable portion having a refillable reservoir, and an information memory configured to store an identifier of the removable portion, the information memory having a memory location for a filling code wherein the memory location is configured to store a first bit for the filling code. The drug packaging system also includes a packager configured to place the discharged drug portions into dispensing packages, and a charging station configured to refill additional drug portions into the reservoir of the removable portion, wherein a value of the stored first bit for the filling code is inverted by the controller after each refilling at the charging station.

One or more embodiments include a method for refilling a reservoir of a first storing and metering station of a dispensing machine with drug portions. The method includes a) removing a removable part of the first storing and metering station, the removable part having an information memory that stores an identifier and contains a memory location for a filling code, wherein the memory location contains a first value for the filling code; b) transporting the removable part to a charging station; c) reading the identifier at the charging station, refilling the removable part with a specified amount of drug portions, and writing a second value for the filling code into the memory location; d) saving the second value, together with the identifier that has been read, in a database configured to be read by a control device; e) transporting the refilled removable part back to the dispensing machine, placing the removable part on a stationary part of the first or a different storing and metering station, and reading the identifier and the filling code of the information memory; and f) comparing the identifier and the value of the filling code to corresponding respective values in the database, and generating an error signal if they do not match wherein the memory location stores a first bit for the filling code, the value of which is inverted by the charging station in step c) after each refilling at the charging station, and the inverted value is saved in the database in step d).

BRIEF DESCRIPTION OF THE DRAWINGS

The invention is explained in greater detail below with reference to a preferred embodiment illustrated in the drawings, wherein.

DETAILED DESCRIPTION

Figure 2:
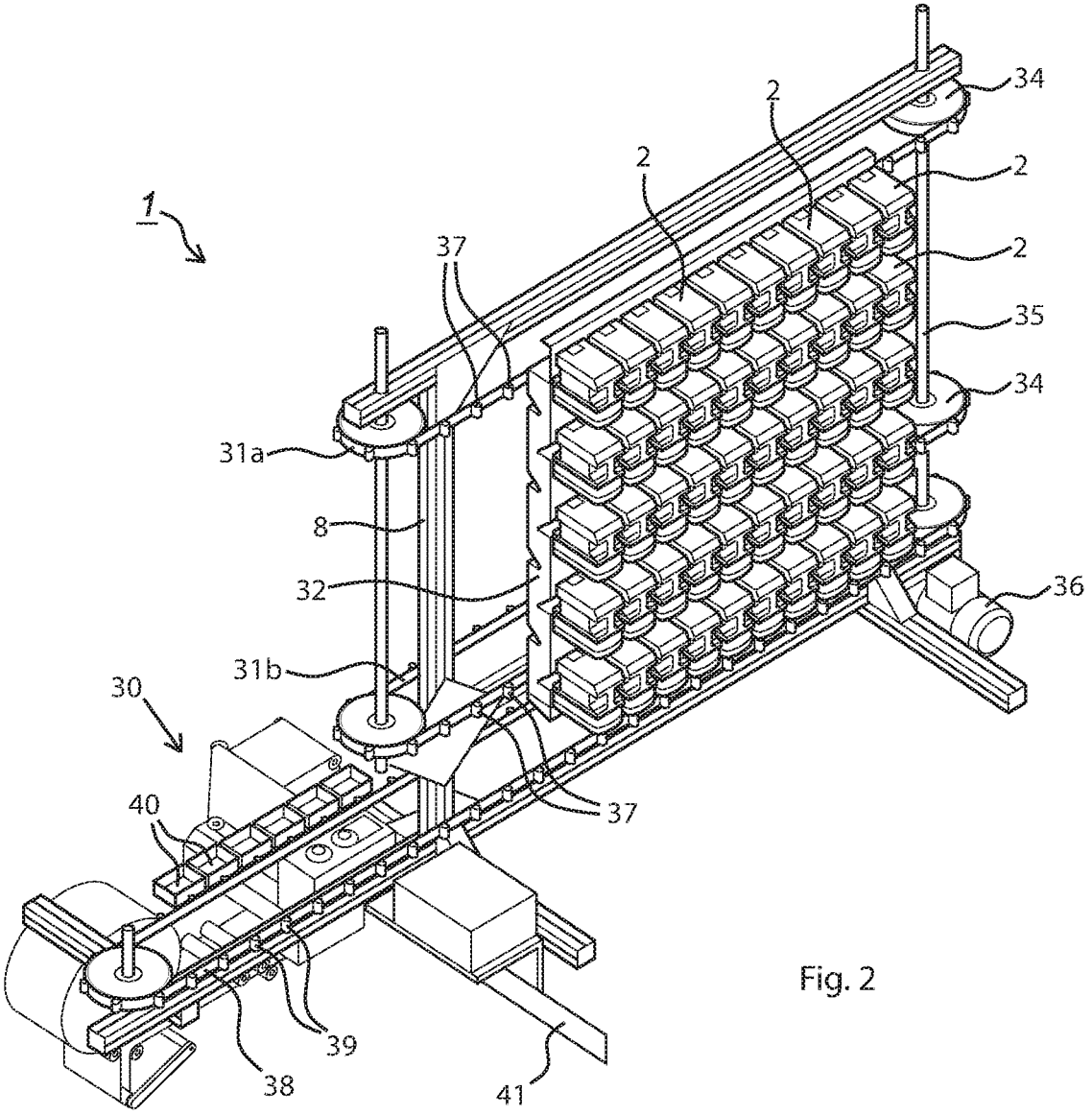
FIG. 2: shows a schematic perspective view of a dispensing machine which can be used in implementing the invention.
Figure 3:
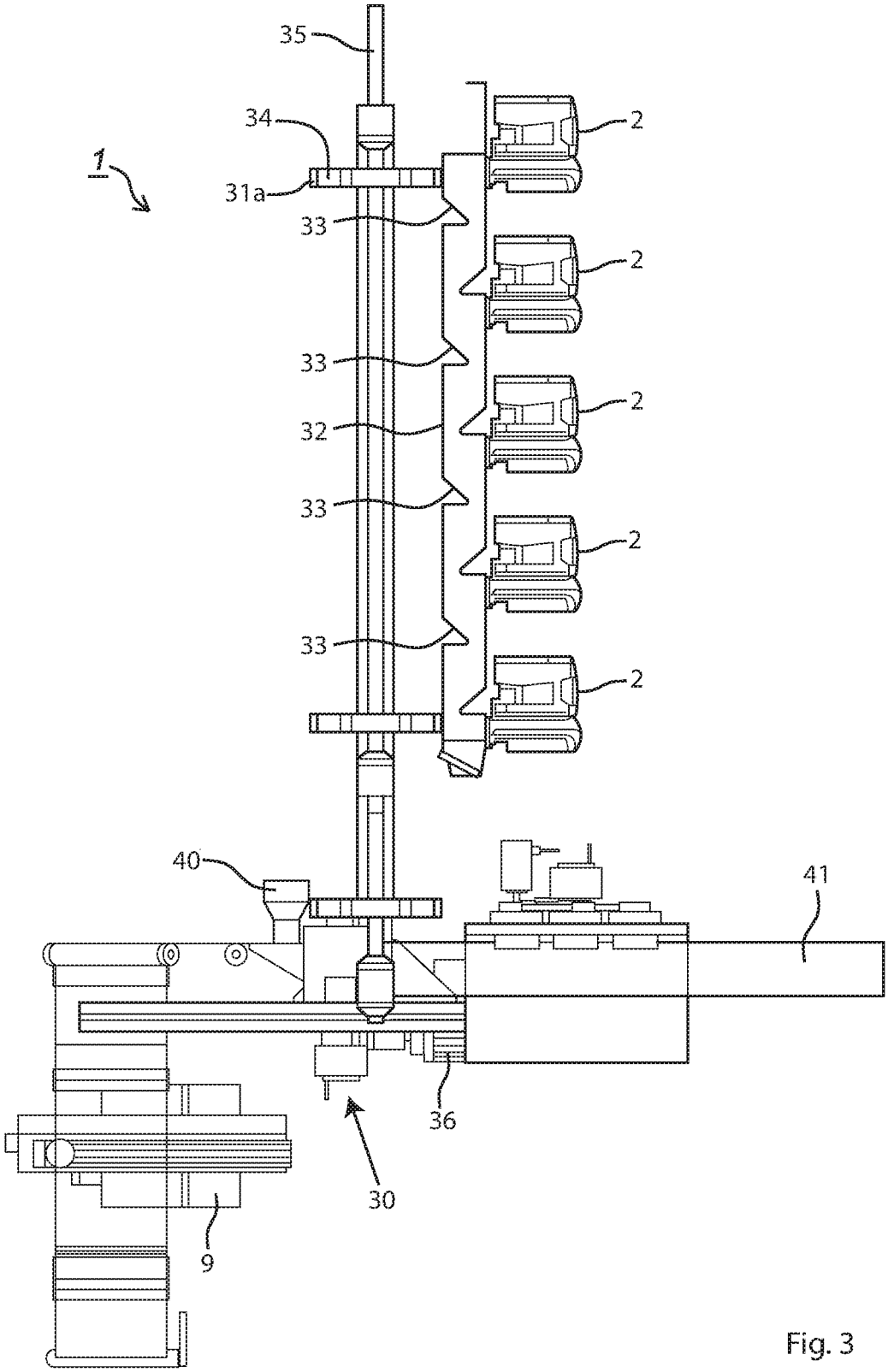
FIG. 3: shows a schematic side view of the dispensing machine in FIG. 2.
Figure 4:
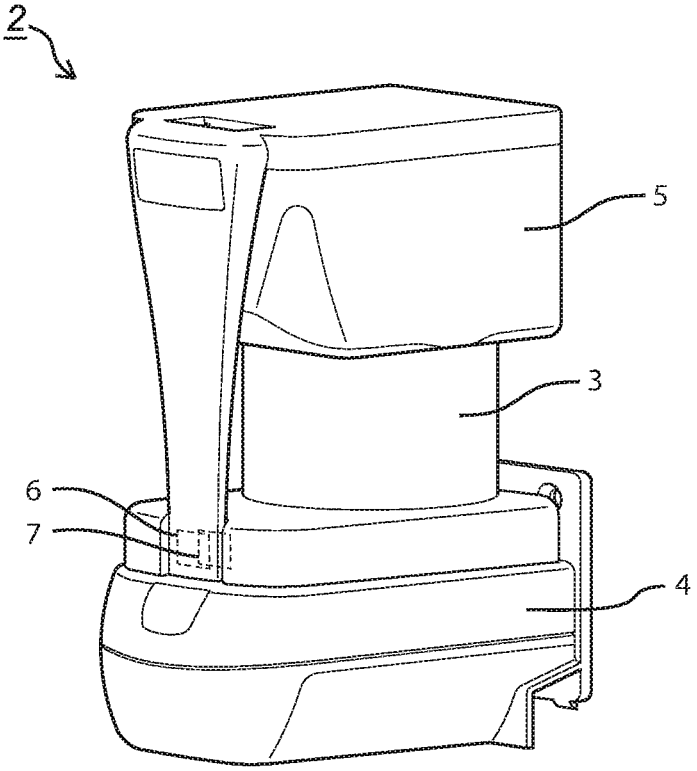
FIG. 4: shows a schematic perspective view of a storing and metering station which can be used in implementing the invention.

FIGS. 2 to 4 show a schematically illustrated dispensing machine 1 which is described in patent application EP 12 182 634.1 (not yet published), and which is used in the arrangement according to the invention and/or is used to carry out the method according to the invention. It is hereby noted at this point that the arrangement according to the invention and the method according to the invention can be carried out with a plurality of dispensing machines with varying forms.

The dispensing machine 1 according to FIG. 2 has a plurality of storing and metering stations 2 arranged in a plane next to and above each other in rows and columns, of which one is shown in FIG. 4. Such a storing and metering station 2 has a stationary part 4 fixed to a frame 8, and a removable part 3 which can be placed thereon. The removable part 3 contains a reservoir 5 for a plurality of identical drug portions, such as tables or capsules, by way of example. The storing and metering station 2 contains a dispensing device by means of which individual drug portions can each be removed from the reservoir 5 and discharged, via the outlet opening situated at right in FIG. 4, via a guide chute included in the stationary part 4, onto a transport path which finally deflects the drug portions in a targeted manner to a packing device wherein they are then placed into dispensing packages in prespecified quantities. For this purpose, each storing and metering station 2 has a controller inside its stationary part 4 which is connected to the central control device 9 of the dispensing machine 1, said controller in turn driving a drive motor of a separation mechanism if the central control device 9 requests the discharge of a drug portion from the associated reservoir 5. The separation mechanism, which is not described in greater detail here, has, in addition to the controller and the drive in the stationary part 4, a separating mechanism which is contained in the removable part 3 and is driven by the drive, said separating mechanism being adapted to the specific shape of the drug portions contained in the respective reservoir 5. By way of example, the separating mechanism has a so-called separation wheel—that is, a rotating cylinder having vertical guide channels adapted to the diameter of the drug portions, able to receive on its upper end, from a prespecified opening of the reservoir 5, a drug portion, and to transfer to the stationary part 4, via an opening on its lower end, at a position which is offset from the opening by rotation, the drug portion contained in the guide channel, such that the drug portion discharged on the stationary part travels through an inclined guide chute and is then discharged at the outlet opening of the stationary part 4. The guide chute through which the drug portion moves is optionally monitored by a sensor to detect the passage of the drug portion. This sensor which detects the drug portion is in turn coupled to the controller of the stationary part 4.

As can be particularly seen in FIG. 3, a vertical column of storing and metering stations 2 arranged above each other can be coupled to a vertical drop shaft 32 in such a manner that inlet openings (not visible) of the drop shaft 32, arranged at right in FIG. 3, are coupled to associated outlet openings of the stationary part 4 of the storing and metering stations 2 in such a manner that drug portions exiting the storing and metering stations 2 enter into the drop shaft 32. In the same, they fall down perpendicularly, wherein the inner walls of projections 33 which protrude into the drop shaft cushion the fall by deflecting the movement of the falling drug portion laterally. Once the drug portions falling in the drop shaft 32 have reached the lower end of the drop shaft 32, they exit the drop shaft 32 and fall into a collecting container 40. In general, multiple drug portions are collected in the collecting containers 40, and must be placed into a dispensing package prepared by the dispensing machine. For this purpose, the collecting containers 40 are emptied from the packing device 30 in such a specific manner that the drug portions exiting the collecting containers 40 fall into an open pocket of a dispensing package provisioned under the collecting containers 40. The pocket and/or the dispensing package is subsequently closed.

In the dispensing machines illustrated in FIGS. 2 to 4, the vertical drop shafts 32 move past the matrix of the storing and metering stations 2 in the horizontal direction such that the inlet openings of the drop shafts 32 are successively connected to the outlet openings of the storing and metering stations 2 arranged horizontally next to each other in a row. To enable this horizontal movement of the vertical drop shafts 32, they are connected both on their upper side and their lower side to transport belts 31*a*, 31*b* running in a horizontal plane, wherein the transport belts 31*a*, 31*b* are guided around drive wheels 34. The drive wheels 34 are in turn mounted on a shaft 35 driven by a drive motor 36. Both transport belts 31*a*, 31*b* have installation fittings 37 at equidistant spacings, wherein the drop shafts 32 are attached to the same. FIG. 2 only shows one vertical drop shaft 32 so as to render the illustration more clearly. In the actual arrangement, the transport belts 31*a* and 31*b* are entirely fitted with drop shafts 32 all around the peripheral surface thereof. A further transport belt 38 is guided via drive wheels underneath the horizontally circulating drop shafts 32, moving at the same speed as the transport belts 31*a*, 31*b*. Installation fittings 39—likewise at equidistant spacings—are positioned on the transport belt 38, and the spacing thereof corresponds to that of the installation fittings 37. The collecting containers 40 are installed on the installation fittings 39, wherein in FIG. 2 only six such collecting containers 40 are shown, by way of example. The entire transport belt 38 is actually covered by collecting containers 40 around its complete peripheral surface. The spacings between the collecting containers correspond to the spacings between the drop shafts. While the drop shafts 32 are moved past the matrix of the storing and metering stations 2 at a prespecified speed, on the lower ends of the drop shafts 32, associated collecting containers 40 are moved synchronously. After one revolution, the collecting containers 40 leave the position of the drop shafts 32 moving along with the same, because the transport belt 38 is guided beyond the region of the transport belts 31*a*, 31*b*, as can be seen in FIG. 2 in the left, forward area. The collecting containers 40 are then guided past the packing device 30 and successively unloaded into corresponding, initially still open, dispensing packages. The dispensing packages are made of weldable plastic films. A continuous film strip 41 can be seen in FIG. 2 and FIG. 3. It is supplied to the packing device 30 (for example from a film roll).

FIG. 3 is a schematic illustration of a housing of the central control device 9, at lower left. This control device 9 is connected via line links (not illustrated) to both the packing device 30 and to all drive motors and all storing and metering stations 2. Moreover, the control device is connected to all of the sensors which monitor the operation of the dispensing machine.

FIG. 4 shows the storing and metering station 2 in the configuration wherein the removable part 3 sits on the stationary part 4. At left in FIG. 4, a vertical hand grip of the removable part 3 can be seen. An RFID component with an information memory 6 is preferably attached at the lower end of the hand grip, which is wirelessly connected to a reading device 6 inserted in the stationary part 4 adjacent to the grip. When the removable part 3 is in place, the reading device 7 can read the information memory 6. The data which is read first arrives at the controller inside the stationary part 4, and from there arrives at the central control device 9.

According to the invention, the information memory 6 stores, among other things, an identifier of the removable part 3, and a filling code—preferably in the form of a time stamp which characterizes the time point of the filling.

Figure 1:
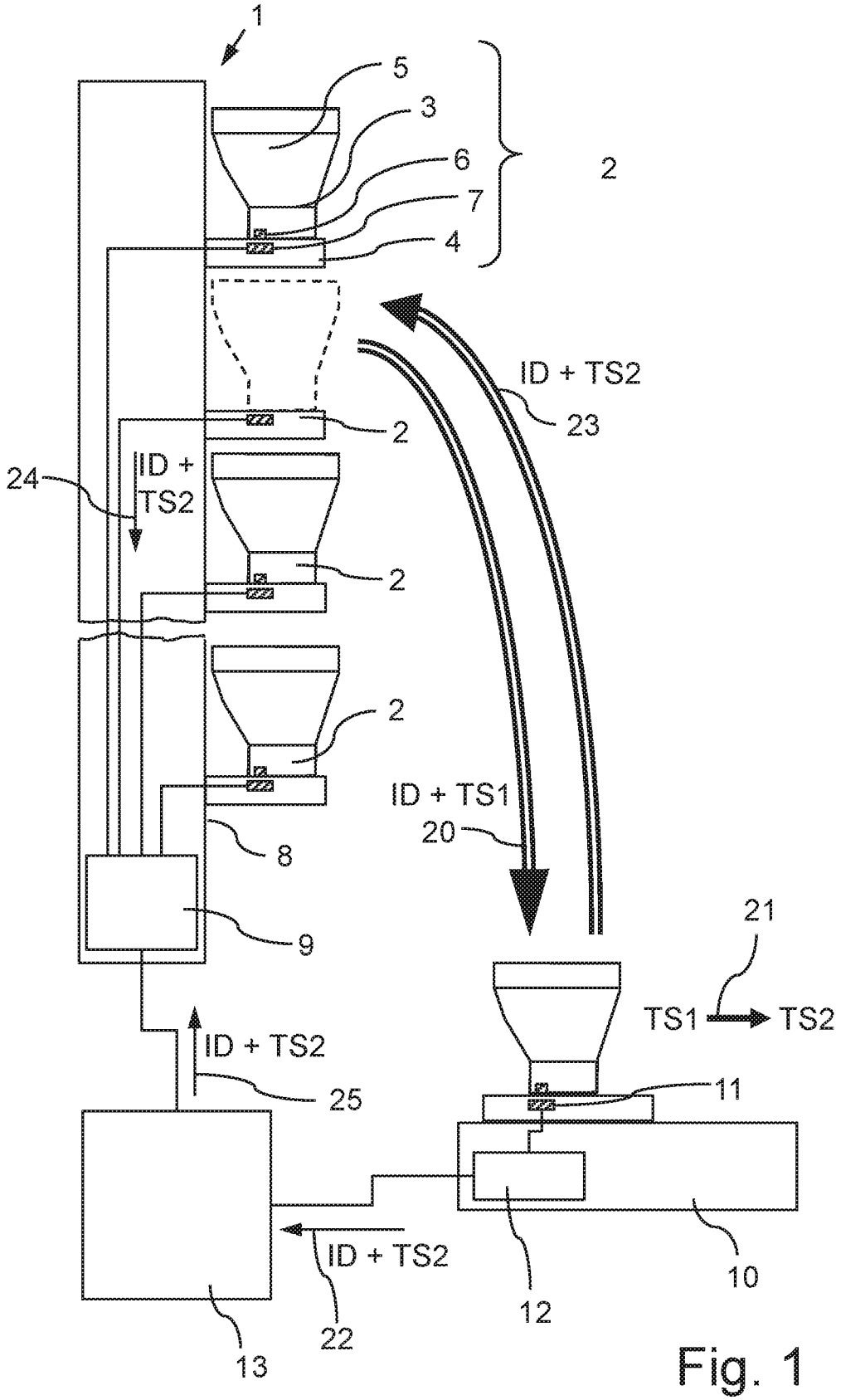
FIG. 1: shows a schematic illustration of the arrangement according to the invention, and of processes in the removal and replacement of the removable part.

The arrangement according to the invention is schematically illustrated in FIG. 1. In addition to the dispensing machine 1, for example with the components described above in reference to FIGS. 2 to 4, the arrangement according to the invention has a charging station 10. Reservoirs of a removable part 3, which has been removed, of a storing and metering station 2, said reservoirs having been emptied, are each filled during operation with a prespecified quantity of drug portions of the same type and size. The charging station 10 contains a read/write device 11 which is able to communicate with the information memory of a removable part 3, placed on the charging station 10, of a storing and metering station 2, in such a manner that it can write a new filling code into the information memory. Every time the reservoir (5) has been refilled, the filling code is changed at the charging station (10), and preferably a time stamp of the filling is written into the information memory 6. The charging station 10 illustrated schematically in FIG. 1 has a controller 12 which is connected to the read/write device 11. The charging station 10 can also have a scales by means of which the weight of the removable part 4 can be continuously determined. In this way, it is possible to check that the correct number of drug portions (with known individual weights) has been filled.

As illustrated in FIG. 1, both the control device 9 of the dispensing machine 1 and the controller 12 of the charging station 10 are coupled to a database 13. The database 13 saves at least one dataset for each removable part 3 of a storing and metering station 2, said dataset containing information on the contents of the reservoir 5 such as the number, type, and the expiration date of the drug portions, by way of example, in addition to the identifier of the removable part 3 and the filling code (time stamp). The control device 9 of the dispensing machine 1 can access the datasets of the database 13 to determine, by querying the database 13 when the discharge of a certain drug portion into a certain dispensing package is requested, which storing and metering station 2 must be activated.

According to the invention, so that the control device 9 always contains the correct data of the drug portions contained in the reservoirs 5 of the storing and metering stations 2, when a reservoir 5 is refilled the following procedure is carried out. First, the assumption is made that the information memory 6 of a removable part 3 of a storing and metering station 2, having an empty reservoir 5, stores an identifier ID of the removable part 3 and a time stamp TS1 of the earlier filling. This removable part 3 is then removed and moved to the charging station 10, which is indicated by the arrow 20. Next to the arrow 20, the indication ID+TS1 shows that the information memory 6 contains the old time stamp TS1 in addition to the identifier ID. After the removable part 3, with the reservoir 5, has been placed on the charging station 10, the controller triggers the charging station 10 to read the information memory 6 by means of the read/write device 11. By means of the identifier ID which has been read, the charging station 10 queries the database 13 and thereby determines the type of the drug portions to be filled. A charging reservoir which is not illustrated in FIG. 1 is brought to the charging station 10, where an identifier attached to the charging reservoir is read. Using the information of the charging reservoir which has been read, and the information queried from the database 13, a check is made as to whether the charging reservoir contains the correct drug portions to be filled. If this is the case, the reservoir 5 is filled from the charging reservoir. In this process, a scales of the charging station 10 is used to check whether the quantity to be filled has been fully deposited into the reservoir 5. If this is not the case, the controller 12 of the charging station 10 triggers its writing device 11 to write a new time stamp as a filling code into the information memory 6 of the removable part 3. This is shown in FIG. 1 by the arrow 21. At the same time, or shortly thereafter, the controller 12 has the new filling code—that is, the new time stamp TS2—written into the database 13 with an assignment to the identifier ID. At the same time, additional information on the drug portions which have been filled is saved in the database 13. This is shown by the arrow 22 in FIG. 1. Next, the newly filled removable part 3 is placed back on its stationary part 4 of the storing and metering station 2, wherein it now contains the identifier ID in its information memory 6 together with the new time stamp TS2. This is shown by the arrow 23. After the placement on the stationary part 4, the control device 9 triggers a reading of the information memory 6 by the reading device 7 of the stationary part 4. This reading of the identifier and of the new time stamp (ID+TS2) is shown by the arrow 24. At the same time, the control device 9 reads the time stamp saved in the dataset of the database 13 addressed with the identifier ID from the database 13, which must be the new time stamp TS2 if the data has been correctly transmitted. This is shown by the arrow 25. Finally, the control device 9 compares the identifier and the time stamp, and generates an error signal if they do not agree. An operator of the arrangement is provided with a message to the effect that either the database 13 or the replaced removable part 3 does not have the required, correct time stamp. Next, a check can be made as to whether there was not a correct transmission of the data from the charging station 10 to the database 13, or whether other errors have arisen. As long as the errors have not been addressed, the affected storing and metering station 2 is deactivated—that is, the discharge of drug portions from this station is halted.

What is claimed is:

1. A drug packing system, comprising:

a controller;

a dispensing machine comprising:

at least one storing and metering station configured to discharge drug portions individually, the storing and metering station comprising:

a stationary portion fixed to the dispensing machine; and a removable portion, the removable portion comprising:

a refillable reservoir; and an information memory configured to store an identifier of the removable portion, the information memory having a memory location for a filling code wherein the memory location is configured to store a first bit for the filling code;

a packager configured to place the discharged drug portions into dispensing packages; and a charging station configured to refill additional drug portions into the reservoir of the removable portion, wherein a value of the stored first bit for the filling code is inverted by the controller after each refilling at the charging station.

2. The system of claim 1, wherein the filling code is a time stamp corresponding to the time at which the charging station is refilled.

3. The system of claim 1, wherein the controller is configured to detect the refilling when the information memory is read by a reading device after the removable portion has been placed back onto the stationary portion of the same or a different storing and metering station.

4. The system of claim 1, wherein a reading device is functionally assigned to the stationary portion and includes a device for wireless communication with the information memory.

5. The system of claim 4, wherein wireless communication procedures of neighboring storing and metering stations are configured to not interfere with each other.

6. The system of claim 1, wherein the stationary portion includes a reading device.

7. The system of claim 1, wherein the information memory is a nonvolatile solid-state memory.

8. The system of claim 1, wherein the information memory is contained in an RFID component.

9. The system of claim 1, wherein the stationary portion includes a first part of a dispensing device, the first part having a drive for driving a separating mechanism to output individual drug portions, and wherein the removable portion includes a second part of the dispensing device, the second part having an outlet opening of the reservoir.

10. The system of claim 9, wherein the second part of the dispensing device contains the separating mechanism, which is matched to the shape of the drug portions.

11. The system of claim 1, wherein the charging station has a read/write device for reading information comprising the identifier of the removable portion from the information memory, and for writing information comprising the filling code to the information memory.

12. The system of claim 1, wherein the memory location is configured to store a second bit for the filling code, the second bit being a check bit.

13. A method for refilling a reservoir of a first storing and metering station of a dispensing machine with drug portions, the method comprising:

a) removing a removable part of the first storing and metering station, the removable part having an information memory that stores an identifier and contains a memory location for a filling code, wherein the memory location contains a first value for the filling code;

b) transporting the removable part to a charging station;

c) reading the identifier at the charging station, refilling the removable part with a specified amount of drug portions, and writing a second value for the filling code into the memory location;

d) saving the second value, together with the identifier that has been read, in a database configured to be read by a control device;

e) transporting the refilled removable part back to the dispensing machine, placing the removable part on a stationary part of the first or a different storing and metering station, and reading the identifier and the filling code of the information memory; and f) comparing the identifier and the value of the filling code to corresponding respective values in the database, and generating an error signal if they do not match wherein the memory location stores a first bit for the filling code, the value of which is inverted by the charging station in step c) after each refilling at the charging station, and the inverted value is saved in the database in step d).

14. The method according to claim 13, wherein the filling code is a time stamp which corresponds to the time at which the charging station is refilled, wherein the time stamp is stored in step c) in the memory location for the filling code, and is saved in the database in step d).

15. The method according to claim 13, wherein an entry which stores the filling code in the database is addressed in step d) by the identifier that has been read.

16. The method according to claim 13, wherein, in step d), in addition to the filling code, details of the new contents of the reservoir are also saved in the database.

17. The method according to claim 16, wherein the details include the number and the expiration date of the drug portions which have been filled.

18. The method according to claim 13, wherein, in step c), the database is queried using the identifier that has been read, and a determination is made using the information saved there as to which type of drug portions must be refilled.

19. The method according to claim 13, wherein, prior to the refilling in step c), a charging reservoir is provided, an identifier attached to the charging reservoir is read, and a determination is made, using the charging reservoir identifier that has been read and the identifier that has been read from the information memory of the removable part, as to whether the charging reservoir contains the correct drug portions to be refilled.

20. The method according to claim 13, wherein the memory location stores a second bit for the filling code that is a check bit.

* * * * *